US005797273A

United States Patent [19]

Guo et al.

[11] Patent Number: 5,797,273

[45] Date of Patent: Aug. 25, 1998

[54] CONTROL OF DEFROST IN HEAT PUMP

[75] Inventors: Zhichao Guo, Fayetteville; Robert P. Dolan, Syracuse, both of N.Y.

[73] Assignee: Carrier Corporation, Syracuse, N.Y.

[21] Appl. No.: 799,945

[22] Filed: Feb. 14, 1997

[51] Int. Cl.[6] ..... F25D 47/02

[52] U.S. Cl. ..... 62/156; 62/80; 62/155

[58] Field of Search ..... 62/156, 151, 152, 62/154, 155, 80, 81, 82, 234, 160; 165/231, 232, 233

[56] References Cited

U.S. PATENT DOCUMENTS 3,777,505 12/1973 Otaki ..... 62/160 X 4,790,144 12/1988 Yokouchi et al. ..... 62/156

4,852,360 8/1989 Harshbarger et al. ..... 62/156 X

*Primary Examiner*—Harry B. Tanner

[57] ABSTRACT

A defrost control for a heat pump system initiates a defrost of the outdoor coil when certain computed condition occur. The conditions include exceeding a limit as to the difference that may be permitted between the maximum indoor coil temperature occurring since the last defrosting of the outdoor coil and the current indoor coil temperature. The limit that may not be exceeded is computed as a function of the maximum indoor coil temperature occurring since the last defrosting of the outdoor coil.

16 Claims, 8 Drawing Sheets

CONTROL OF DEFROST IN HEAT PUMP

BACKGROUND OF THE INVENTION

This invention relates generally to defrosting the outdoor coil of a heat pump system and, more particularly, to an apparatus and method for timely initiating the defrosting action of the outdoor coil.

One of the frequently encountered problems associated with an air source heat pump system is that during heating operations, the outdoor coil will tend to accumulate frost under certain outdoor ambient conditions. The accumulation of frost on the outdoor coil produces an insulating effect which reduces the heat transfer between the refrigerant flowing through the coil and the surrounding medium. Consequently, after a build up of frost on the outdoor coil, the heat pump system will lose heating capacity and the entire system will operate less efficiently. It is therefore desirable to initiate defrost before this build up of frost occurs thereby impacting the efficiency of the heat pump. It is also desirable to not unnecessarily initiate a defrost of the outdoor coil until such frosting occurs since each defrost of an outdoor coil removes heat from the enclosure to be heated due to the reversal of the refrigeration system.

Different types of defrost initiation systems have been utilized to timely initiate defrost. These systems have included the monitoring of certain temperature conditions experienced by the heat pump system. These temperature conditions are usually compared against certain predetermined limits. These predetermined limits are usually fixed and do not take into account changes in the manner in which the heat pump may be operating.

SUMMARY OF THE INVENTION

It is an object of the invention to initiate a defrost action only after certain temperature measurements are performed and compared with real time computations as to the appropriate threshold values for the sensed temperature conditions.

It is another object of the invention to control the initiation of a defrost action so as to thereby minimize the number of defrost cycles which otherwise might occur due to prematurely triggering defrost as a result of comparing temperature conditions against only predetermined thresholds that do not always accurately reflect when defrost should occur.

The above and other objects of the invention are achieved by providing a programmed computer control for a heat pump system that initiates defrost action only when the same becomes necessary as a result of having computed on a real time basis the appropriate threshold to be used against a certain sensed temperature. The programmed computer control first notes the current temperature of the indoor coil of the heat pump system and examines it for being greater than any previously noted maximum indoor coil temperature that may have occurred following a previous defrost of the outdoor coil. The current indoor coil temperature becomes the maximum noted indoor coil temperature in the event that it exceeds any previously noted maximum indoor coil temperature. The above examination of the indoor coil temperature is preferably done only after certain components of the heat pump system have been running without interruption for a predetermined period of time. In particular, the indoor fan associated with the indoor coil must not have changed fan speed within a predetermined period of time during which the compressor and outdoor fan remain on.

In accordance with the invention, an amount is computed by which the indoor coil temperature may drop below the noted maximum indoor coil temperature. This amount is continually computed as a function of the present value of the maximum indoor coil temperature. A defrost of the outside coil is preferably initiated if the current indoor coil temperature is below the noted maximum indoor coil temperature by the computed amount. This initiation of a defrost of the outdoor coil is preferably made subject to certain further time parameters such as the total time of operation of the heat pump system's compressor and the actual outdoor coil temperature.

The mathematical relationship used to compute the aforementioned amount is preferably derived by observing the operation of a heat pump system having the characteristics of the particular heat pump system being controlled. These observations include initiating a heating operation of such a heat pump system under a given set of conditions such as outdoor temperature, indoor room temperature and fan speeds and noting the indoor coil temperatures over time. At some point, the temperature of the indoor coil will drop significantly indicating that the outdoor coil has become frosted to the point that the heat transfer of the circulating refrigerant to the indoor coil is substantially impaired. The difference between the maximum value of the indoor coil temperature and the temperature of the indoor coil when substantial frosting of the outdoor coil occurs is noted as a permissible difference that is not to be exceeded.

The noted permissible difference that is not to be exceeded and the maximum indoor coil temperature will become one point on a graph of maximum noted indoor coil temperatures and correspondingly noted permissible differences. It has been found that the ultimately developed mathematical relationship between permissible difference and maximum indoor coil temperature is a non-linear relationship. This non-linear relationship is preferably reduced to a series of linear relationships for ease of computation within the programmed computer controlling the heat pump system.

BRIEF DESCRIPTION OF THE DRAWINGS

Other objects and advantages of the present invention will be apparent from the following detailed description in conjunction with the accompanying drawings, in which:

FIGS. 5A through 5D illustrate the sequence of steps to be performed by the computer control for the heat pump system in carrying out the initiation of a defrost action of the outside coil.

DESCRIPTION OF THE PREFERRED EMBODIMENT

Figure 1:
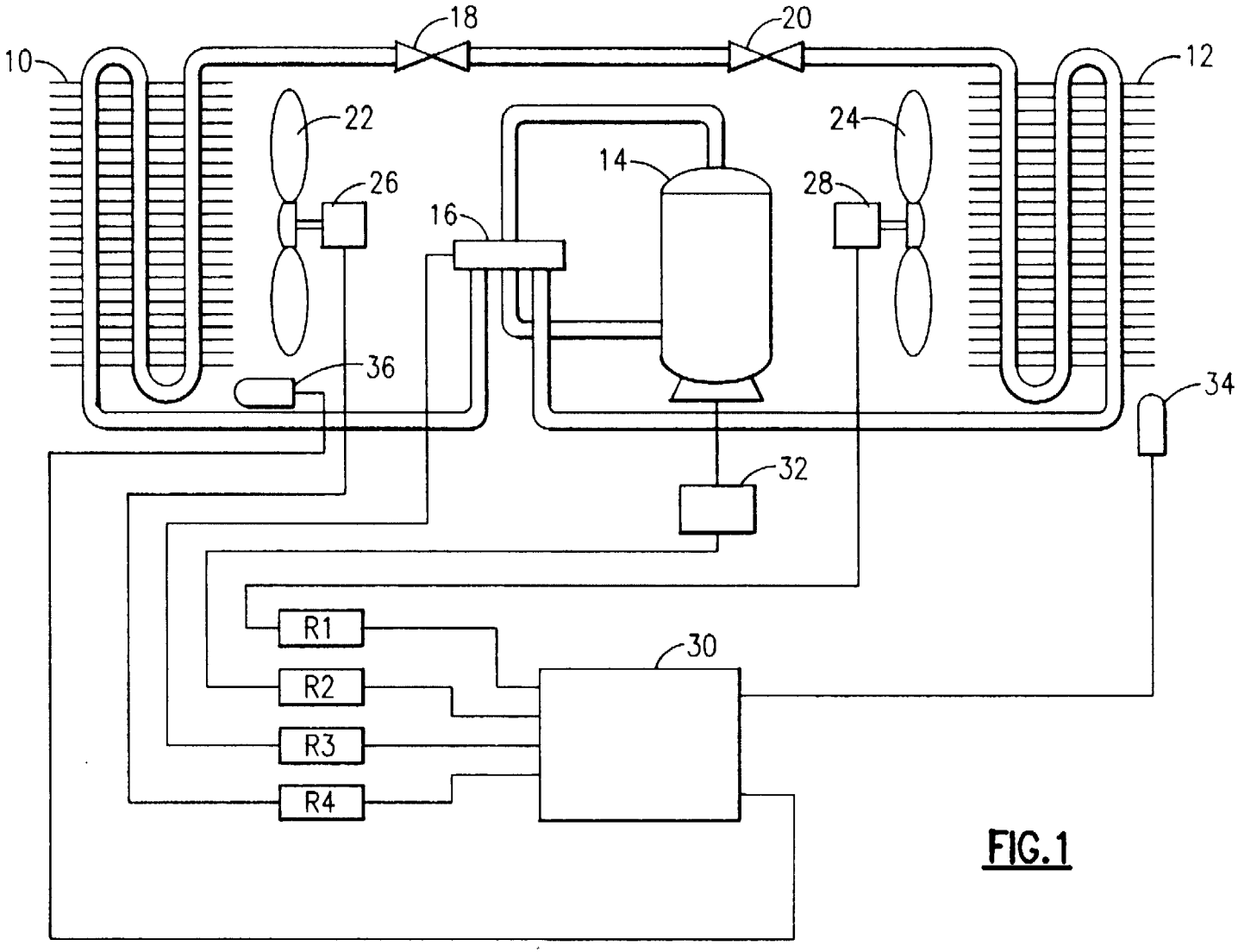
FIG. 1 is a schematic illustration of a heat pump system including a programmed computer control therein.

Referring to FIG. 1, a heat pump system is seen to include an indoor coil 10 and an outdoor coil 12 with a compressor 14 and a reversing valve 16 located therebetween. Also located between the indoor and outdoor coils are a pair of bi-flow expansion valves 18 and 20, which allow refrigerant to flow in either direction as a result of the setting of the reversing valve 16. It is to be appreciated that all of the aforementioned components operate in a rather conventional manner so as to allow the heat pump system to provide cooling to the indoor space while operating in a cooling mode or providing heating to the indoor space while operating in a heating mode.

Indoor fan 22 provides a flow of air over the indoor coil 10 whereas an outdoor fan 24 provides a flow of air over the outdoor coil 12. The indoor fan 22 is driven by a fan motor 26 whereas the outdoor fan 24 is driven by a fan motor 28. It is to be appreciated that the indoor fan motor may have at least two constant drive speeds in the particular embodiment. These drive speeds are preferably commanded by a control processor 30 that controls the fan motor 26 through relay drivers. The fan motor 28 is preferably controlled by relay drive R1. The reversing valve 16 is also controlled by the control processor 30 operating through the relay circuit R3. The compressor 14 is similarly controlled by the control processor 30 acting through relay circuit R2 connected to a compressor motor 32.

Referring to the control processor 30, it is to be noted that the control processor receives outdoor coil temperature values from a thermistor 34 associated with the outdoor coil 12. The control processor 30 also receives an indoor coil temperature value from a thermistor 36.

It is to be appreciated that the control processor 30 is operative to initiate a defrost action when certain temperature conditions indicated by the thermistors 34, and 36 occur. In order for the control processor 30 to detect the particular temperature conditions giving rise to a need to defrost, it is necessary that it perform a particular computation involving the indoor coil temperature as normally provided by thermistor 36. The particular computation performed by the control processor is based on having preferably conducted a series of tests of a particularly design of heat pump system of FIG. 1 as will now be described.

Figure 2:
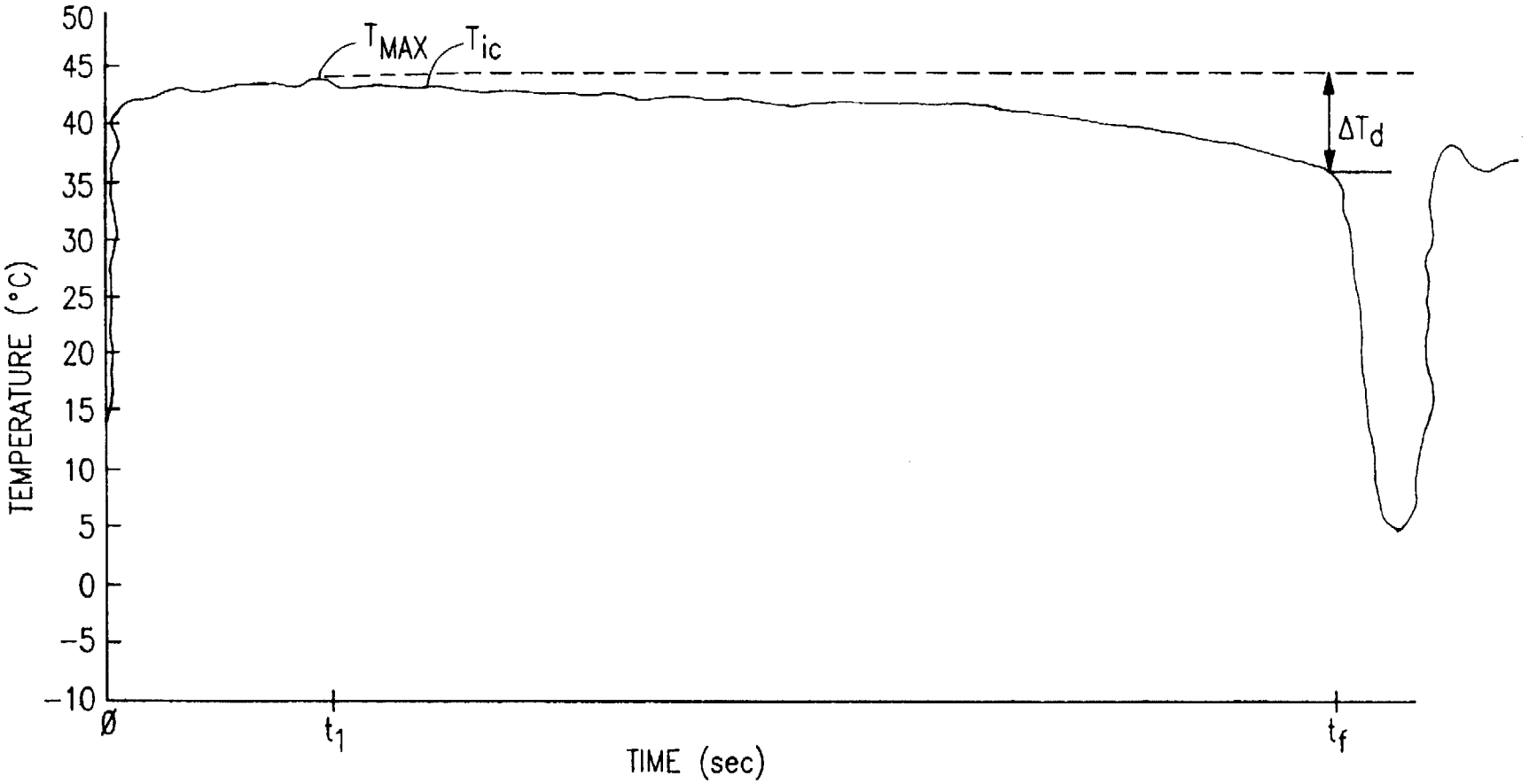
FIG. 2 is an illustration of the pattern of the temperature of the indoor heating coil produced by the heat pump system of FIG. 1 when in a particular heating situation.

Referring to FIG. 2, a graph depicting the temperature of the indoor coil temperature of the heat pump system of FIG. 1 for a given heating cycle is illustrated. The heating cycle occurs under a given set of ambient conditions and a given set of system conditions for the heat pump system. The ambient conditions include particular outdoor and beginning indoor air temperatures. The system conditions include particular fan speed settings and a particular amount of refrigerant indoor coil temperature as measured by thermistor 36 is noted at periodic time intervals. At some point, the temperature of the indoor coil, $T_{ic}$ will have reached a maximum temperature as indicated by $T_{MAX}$ occurring at time $t_1$. The heating cycle will continue beyond $t_1$ with the temperature of the indoor coil $T_{ic}$ dropping off as frost begins to build up on the outdoor coil due to a cool outdoor temperature and the amount of moisture at this cool outdoor temperature. At some point in time, $t_f$, a significant amount of frost will have built up on the outdoor coil thereby causing a significant drop-off in the indoor coil temperature. This drop off in the indoor coil temperature is due to the decrease in heat transfer capacity of the circulating refrigerant as a result of a loss in the evaporator efficiency of the frosted outside coil. The difference between the maximum temperature of the indoor coil occurring at $t_1$ and the temperature of the indoor coil occurring at $t_f$ is noted as a defrost temperature difference, $\Delta T_d$.

In accordance with the invention, the defrost temperature difference $\Delta T_d$ at time $t_f$ and the value of $T_{MAX}$ at time $t_1$ are both noted for the particular heating run. It is to be understood that additional heating runs will be conducted for other sets of particular ambient conditions and other sets of particular system conditions. The defrost temperature difference $\Delta T_d$ and the maximum indoor coil temperature $T_{MAX}$ will be noted for each such run. All noted values of $\Delta T_d$ and $T_{MAX}$ will be thereafter used as data points in a graph such as FIG. 3 to define a relationship between $\Delta T_d$ and $T_{MAX}$.

Figure 3:
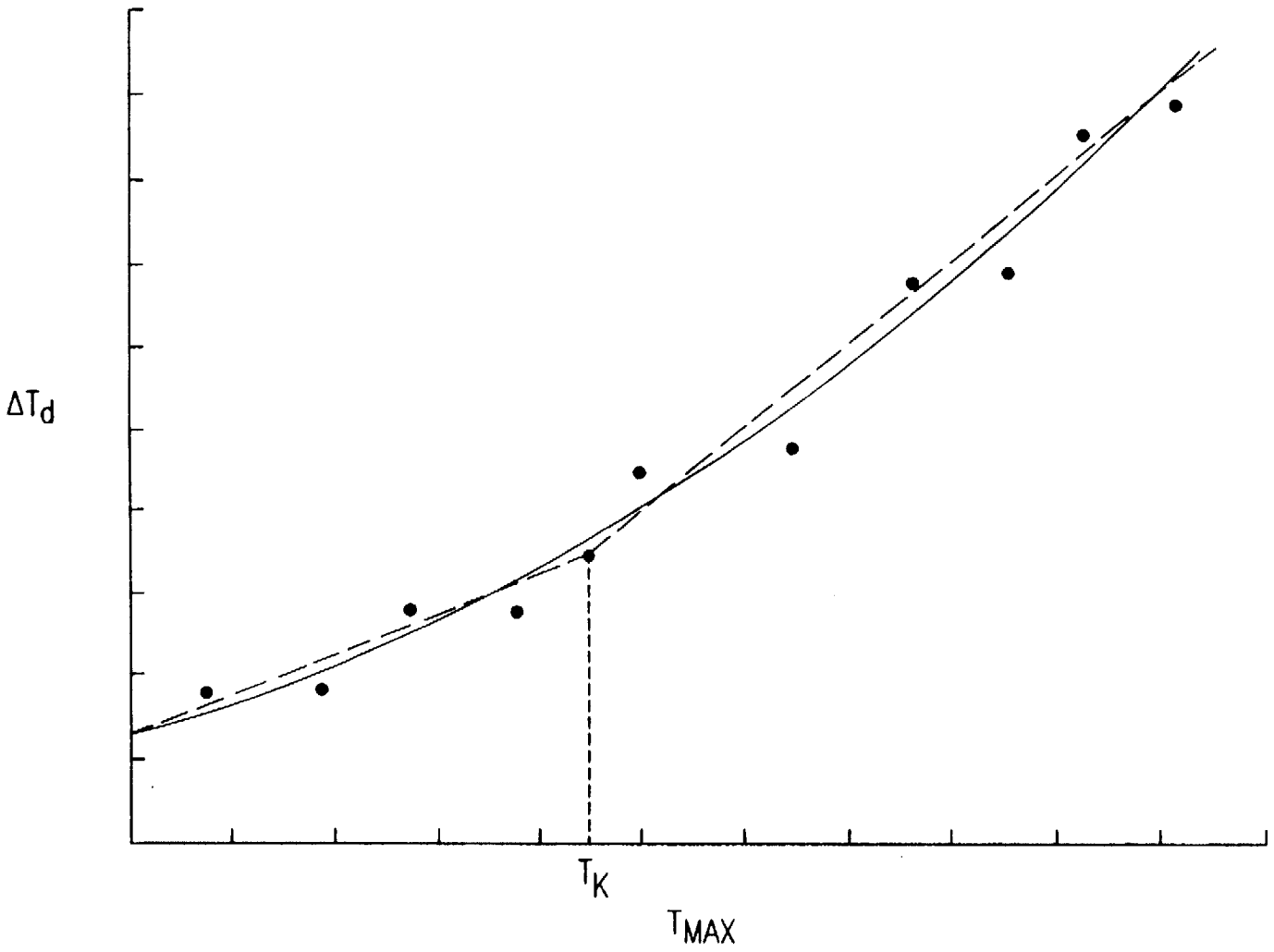
FIG. 3 illustrates how an allowable difference between the maximum indoor coil temperature and measured indoor coil temperature will vary as a function of the maximum indoor coil temperature.

Referring to FIG. 3, the curve drawn through the various data points produced by the heating tests of the particularly designed heat pump system is seen to be non-linear. This curve is preferably broken down into two linear segments with the first linear segment having a slope $S_1$, ending at a $T_{MAX}$ of $T_K$ and the second linear segment having a slope of $S_2$ beginning at the same point. The two linear segments may be expressed as follows:

$$\text{for } T_{MAX} \leqq T_K,\ \Delta T_d = S_1 * T_{MAX} - C_1$$

$$\text{for } T_{MAX} \geqq T_K,\ \Delta T_d = S_2 * T_{MAX} - C_2$$

$C_1$ and $C_2$ are the $\Delta T_d$ coordinate values when $T_{MAX}$ equals zero for the respective linear segments. It is to be appreciated that the particular values of $T_K$, $S_1$, $S_2$, $C_1$ and $C_2$ will depend on the particular design of the heat pump system that has been tested. In this regard, each design of a heat pump system will have particularly sized components such as fans, fan motors, coil configurations and compressors that would generate their own respective FIGS. 2 and 3 and hence their own $T_K$, $S_1$, $S_2$, $C_1$ and $C_2$ values. As will be explained in detail hereinafter, the linear relationships derived for a particularly designed heat pump system will be used by the control processor 30 in a determination as to when to initiate a defrost of the outdoor coil 12 of such a system.

Figure 4:
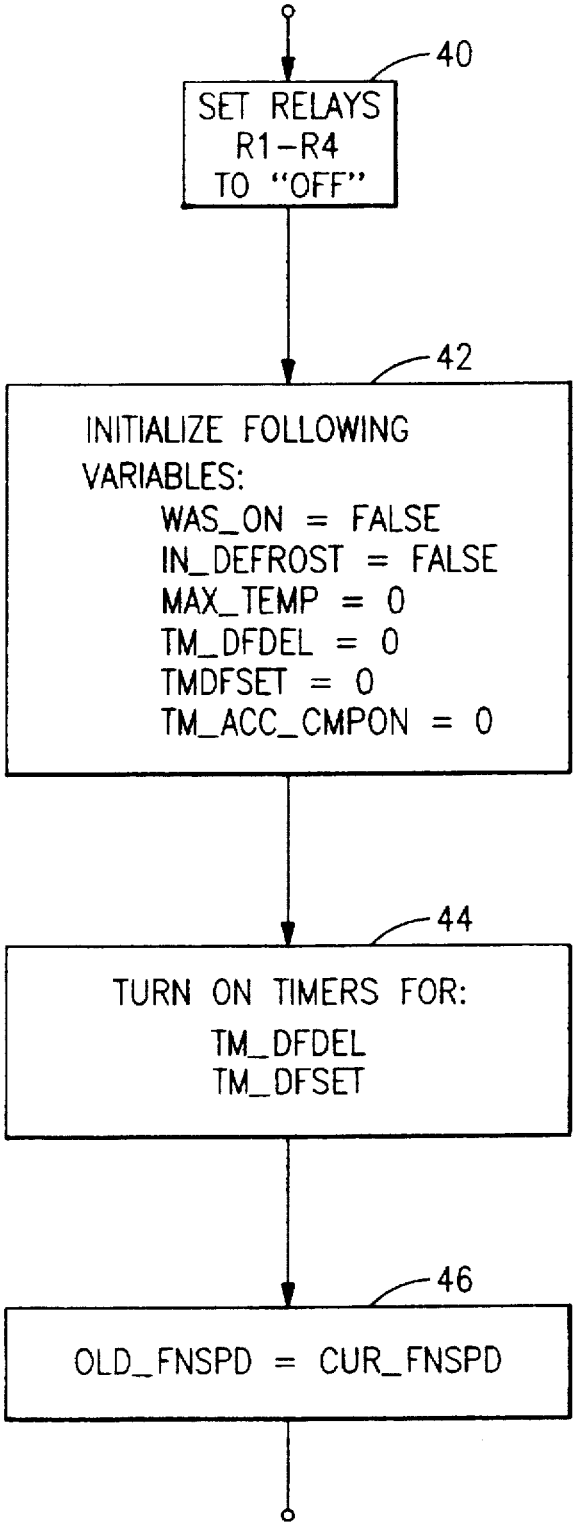
FIG. 4 illustrates a process implemented by the computer control of the heat pump system upon power up of the entire system.

Referring to FIG. 4, a series of initializations are undertaken by the control processor 30 before implementing any defrost control of the heat pump system. These initializations include setting the relays RI through R4 to an off status so as to thereby place the various heat pump system components associated therewith in appropriate initial conditions. This is accomplished in a step 40. The processor unit proceeds to a step 42 and initializes a number of software variables that will be utilized within the defrost logic. A number of timers are turned on so as to continuously provide times to the variables TM_DFDEL and TM_DFSET. Finally, the processor unit will set a variable, OLD_FNSPD, equal to a current fan speed variable, CUR_FNSPD, in a step 46. It is to be appreciated that the above steps only occur when the processor unit is powered up so as to begin control of the heat pump system.

Referring now to Figure SA, the process implemented by the control processor 30 so as to timely initiate defrost of the outdoor coil 12 begins with a step 50 wherein inquiry is made as to whether compressor relay R2 is on. Since this relay will initially be set off, the control processor 30 will proceed to a step 52 and inquire as to whether a variable "WAS_ON" is equal to true. Since WAS_ON is false, the processor will proceed along a no path to a step 54. The processor will next proceed to inquire whether the compressor relay R2 is on in step 54 before setting the variable "WAS_ON" equal to false in a step 56. Inquiry will next be made in a step 58 as to whether IN_DEFROST is equal to true. Since IN_DEFROST is initially set equal to false at power up, the control processor will proceed to a step 60 and inquire whether the heat mode has been selected. In this regard, it is to be appreciated that a control panel or other communicating device associated with the control processor 30 will have indicated whether the heat pump system of FIG.

1 is to be in a heat mode of operation. If the heat mode has not been selected, the processor will proceed along a no path to a step 62 in FIG. 5C and set the variable TM_ACC_CMPON equal to zero. The processor will also set a variable MAX_TEMP equal to zero in a step 64 and a variable TM_DFDEL equal to zero in a step 66. The control processor continues from step 66 to a step 68 and again inquires as to whether the compressor relay R2 is on. If the compressor relay R2 is not on, the processor proceeds out of step 68 to step 70 and sets TM_DFSET equal to zero. Inquiry is next made as to whether IN_DEFROST is equal to true in a step 72. Since this variable is initially false, the control processor 30 will proceed to an exit step 74.

It is to be appreciated that the control processor 30 will execute various processes for controlling the heat pump system following an exit from the particular logic of FIGS. 5A–5D. The processing speed of the control processor 30 will allow the control processor to return to execution of the logic of FIG. 5A in milliseconds. It is also to be appreciated that at some point a heating mode will be selected and heating will subsequently be initiated by the control processor 30 if the room air temperature as measured by a thermostat is less than a desired temperature setting. When heating is to take place, the control processor 30 preferably turns on the indoor and outdoor fans 22 and 24 as well as the compressor motor 32. The reversing valve 16 will also be set so as to cause refrigerant to flow from the compressor to the indoor coil 10 and hence to the outdoor coil 12.

Referring to step 50, the control processor will again inquire as to whether the compressor relay R2 is on following the initiation of heating. It is to be appreciated that the compressor relay R2 will have been activated by the processor when heating is called for. The control processor will note the same as having occurred in step 50 and proceed to step 76 to inquire whether the variable WAS_ON is false. Since this variable is currently false, the processor will proceed to a step 78 and turn off the timers associated with TM_CMPON and TM_ACC_CMPON. The processor will next inquire as to whether the compressor relay R2 is on and proceed to step 80 since the compressor relay R2 is now on. This will result in the variable WAS_ON being set equal to true in step 80. The processor will proceed through steps 58 and 60 as previously discussed. Since the heat mode has been selected, the processor will proceed from step 60 to step 81 and inquire whether a timing variable TM_DFSET is greater than sixty seconds. Since this variable will initially be zero, the processor will proceed to step 66 in FIG. 5C and set the timing variable TM_DFDEL equal to zero. The processor will next inquire whether the compressor relay R2 is on in step 68. Since the compressor relay will have been activated by the control processor in response to a demand for heat, the processor will proceed to step 82.

Referring to step 82, the processor inquires whether the outdoor fan relay is on. The outdoor fan relay R1 will normally be on if the heat pump system is responding to a demand for heat. This will prompt the control processor to proceed along the yes path to a step 84 wherein the indoor fan speed is read. It is to be appreciated that the indoor fan will have been activated when heating has been initiated thereby causing the fan speed to be other than zero. This fan speed is available within the control processor as a result of the control processor having commanded the speed by other control software. This fan speed is set equal to the variable CUR_FNSPD and is compared in step 86 with the present value of old fan speed denoted as OLD_FNSPD. Since this latter variable is initially zero, the control processor will proceed out of step 86 to set the old fan speed variable equal to the value of the current fan speed in a step 88. The control processor proceeds to set the timing variable TM_DFSET equal to zero in step 70 before again inquiring whether IN_DEFROST is equal to true in step 72. Since IN_DEFROST is false, the control processor will proceed along the no path from step 72 to exit step 74.

Referring once again to FIG. 5A, it is to be appreciated that the next execution of the defrost logic will again prompt the processor to inquire whether the compressor is on. Since the compressor relay is now on, the processor proceeds to step 76 to inquire as to the status of "WAS_ON". Since this variable is now true, the control processor will proceed to step 54 wherein the compressor relay R2 is again noted as being on, thereby prompting the processor to proceed through steps 80, 58 and 60 to step 81. Referring to step 81, it is to be noted that the processor is examining the time count of TM_DFSET for being greater than sixty seconds. It is to be appreciated that this variable will have begun accruing a count of time once old fan speed was set equal to the current fan speed in step 88. This variable will continue to accrue time during each successive execution of the defrost logic as long as the compressor relay R2 remains on, the outdoor fan remains on, and the indoor fan speed does not change. In this manner, the time count reflected in TM_DFSET will be a measure of the amount of time that the above three conditions of compressor, outdoor fan and indoor fan status have remained constant. The control processor 30 will thereby have imposed a level of consistency on the heat pump system having run without any change to these components for at least sixty seconds.

Figures 5, 5A:
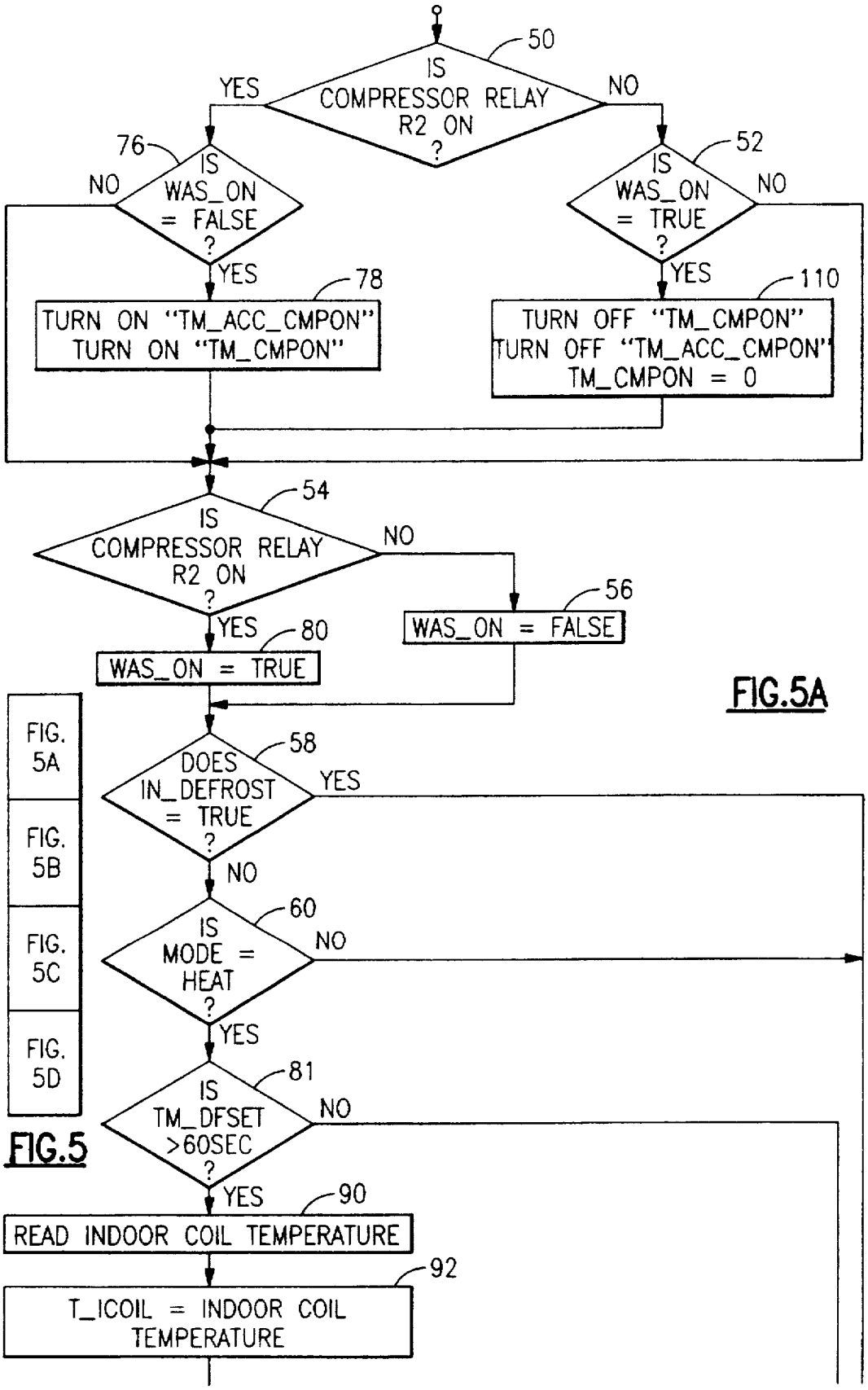
FIG. 5 illustrates how
FIGS. 5A through 5D are aligned.
Figure 5B:
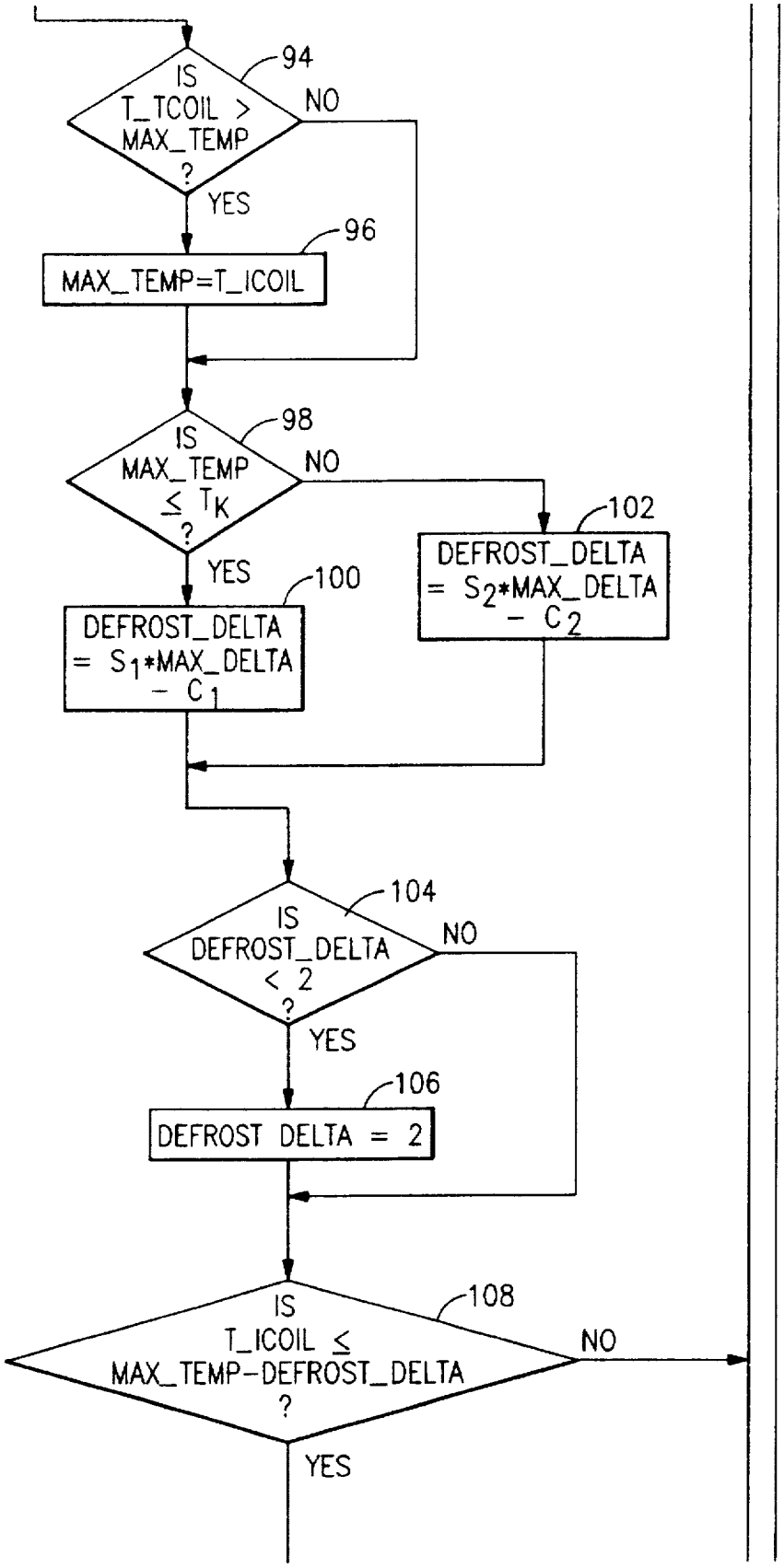
Figure 5C:
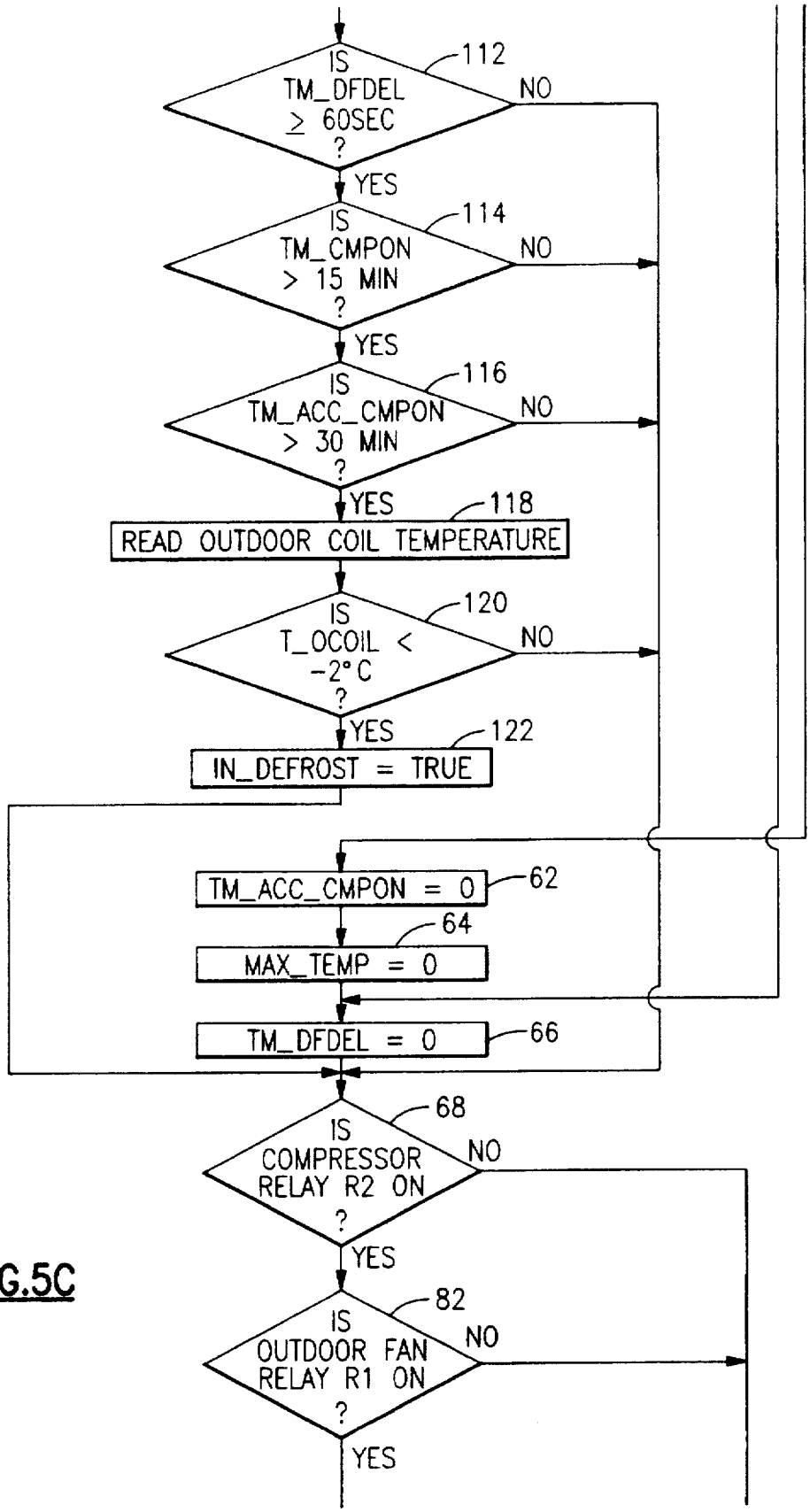
Figure 5D:
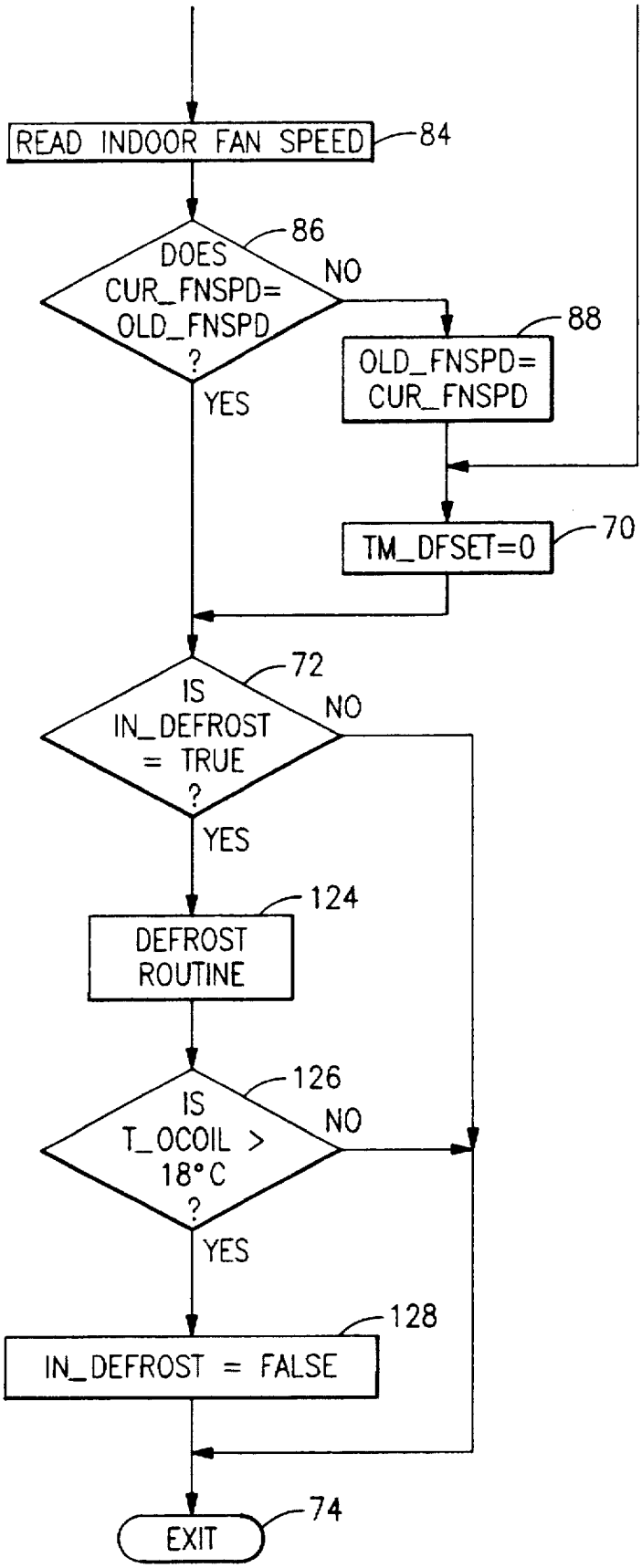

When the time count maintained by TM_DFSET reaches a value greater than sixty seconds, the control processor will proceed from step 81 to step 90 in FIG. 5A and read the indoor coil temperature provided by thermistor 36. This value will be stored as T_ICOIL in step 92. The control processor will proceed to step 94 wherein an inquiry is made as to whether the value of T_ICOIL is greater than the value of a variable MAX_TEMP. It is to be appreciated that the value of MAX_TEMP will be zero when the control processor first initiates heating following heating mode have been selected. This will prompt the control processor to set MAX_TEMP equal to the current value of T_ICOIL in step 96. It is to be appreciated that the control processor will most likely continue to adjust the MAX_TEMP equal to the current value of T_ICOIL as the control processor repeatedly executes the defrost logic and encounters a rising value of T_ICOIL due to the indoor coil temperature rising. The control processor proceeds directly to step 98 following any adjustment to MAX_TEMP in step 96. The control processor proceeds to a step 98 from step 94 in the event that the value of T_ICOIL is less than the presently stored value of MAX_TEMP.

Referring to step 98, the control processor proceeds to inquire whether MAX_TEMP is less than or equal to $T_K$. It will be remembered that the value of $T_K$ was arrived at in FIG. 3. In the event that MAX_TEMP is less than or equal to $T_K$, the control processor will proceed to a step 110 and calculate a value of DEFROST_DELTA. It is to be understood that the mathematical relationship between DEFROST_DELTA and MAX_TEMP in step 110 is the same as the linear relationship of $\Delta T_d$ to $T_{MAX}$ for $T_{MAX}$ less than or equal to $T_K$ in FIG. 3. Referring again to step 98, in the event that the value of MAX_TEMP is not less than or equal to $T_K$, the control processor will proceed along the no path to a step 102 and calculate the appropriate value of DEFROST_DELTA. It is to be appreciated that this calculation is the same as the relationship of $\Delta T_d$ versus $T_{MAX}$ in FIG. 3 for $T_{MAX}$ greater than $T_K$. The processor proceeds from having calculated an appropriate value of DEFROST_DELTA in either step 100 or 102 to a step 104 wherein inquiry is made as to whether the calculated value is less than two. In the event that the calculated value is less than two, the control processor adjusts the same to be equal to two in step 106. The control processor will thereafter proceed directly to step 108. It is to be noted that the processor will also have proceeded to step 108 via the no path from step 104 in the event the DEFROST_DELTA is equal to or greater than two.

Referring to step 108, inquiry is made as to whether the current value of T_ICOIL is less than the difference between MAX_TEMP and DEFROST_DELTA. It is to be appreciated that the inquiry being made in step 108 is essentially a check as to whether the currently measured indoor coil temperature has decreased to a value that is more than the value of DEFROST_DELTA below the maximum indoor coil temperature as defined by the value of MAX_TEMP. It is to be appreciated that the value of the currently measured indoor coil temperature will normally not have decreased to such a value since the outdoor coil will normally not experience a significant frost build up. In such situations, the control processor will continue to pursue the no path out of step 108 and proceed through steps 66, 68, 82, 84, 86, 72 and 74, and eventually re-execute the defrost logic of FIGS. 5A–5D. When the heat demand has been satisfied, the control processor will turn the compressor relay R2 off thereby terminating the particular time period of heating. When this occurs, the control processor will note that the compressor relay R2 is off in the next execution of the defrost logic. This will prompt the processor to note that "WAS_ON" being true in step 52 requires execution of a step 110 wherein the time count being stored in "TM CMPON" and TM_ACC_CMPON is turned off thereby holding these variables at a particular count of time. The control processor resets the time count of TM_CMPON equal to zero in step 110. The control processor does not however reset the time count stored in TM_ACC_CMPON. In this manner, the variable TM_ACC_CMPON continues to accrue a time count each time the compressor is noted as being turned on or off in step 50.

It is to be appreciated that the control processor will continue to timely execute the defrost logic of FIGS. 5A–5D. It will moreover normally execute steps 50, 76, 54, 80, 58, 60 and 81 and thereafter exit the defrost logic when heat is demanded. This will continue until such time as the heat pump system conditions required in steps 68, 82, 84 and 86 have been satisfied. At this time, the control processor will again proceed to read the indoor coil temperature and update the value of MAX_TEMP if necessary. The control processor will thereafter perform the appropriate calculation of DEFROST_DELTA. This will lead to step 108 wherein inquiry will be made as to whether the currently measured temperature, T_ICOIL, has decreased to a value that results in this measured temperature being more than the value of DEFROST_DELTA below the maximum indoor coil temperature as defined by the value of MAX_TEMP. In the event that this occurs, the control processor will presume that the outdoor coil 12 has experienced significant frost requiring a defrost action. The control processor will proceed to a step 112 and inquire whether the time value of TM_DFDEL is greater than sixty seconds. This variable will have begun a running count of seconds from the previous complete execution of the defrost logic occurring immediately prior to the control processor first proceeding from step 108 to step 112. Until such time as this variable indicates a value greater than sixty seconds, the control processor will exit step 112 along the no path to step 68 and thereafter normally proceed through step 82, 84, 86 and 72 and hence along the no path out of step 72 to exit step 74. Referring again to step 112, when the control processor has cycled through the defrost logic several times so as to allow the time to build in TM_DFDEL to a time greater than sixty seconds, then the control processor will proceed to step 114. Referring to step 114, inquiry is made as to whether the time value indicated by TM_CMPON is greater than fifteen minutes. It will be remembered that this particular timing variable is turned on in a step 78 following the control processor having noted that the "WAS_ON" variable is false indicating that the compressor 14 had just previously been turned on. This effectively means that the time being recorded by TM_CMPON is indicative of the total amount of time that the compressor 14 has been on since most recently being activated by the control processor. As long as the total amount of time that the compressor has been on since its most recent activation is less than or equal to fifteen minutes, the control processor will proceed along the no path out of step 114 and execute steps 68, 82, 84, 86, 72 and 74 as has been previously discussed. If the total amount of compressor on time since last being activated exceeds fifteen minutes, the control processor will proceed along the yes path from step 114 to a step 116 to inquire whether the time indicated by the variable TM_ACC_CMPON is greater than thirty minutes. Referring to step 62, it is to be noted that the timing variable TM_ACC_CMPON is set equal to zero when the heating mode is not selected as noted in step 60. It is also to be noted that the timing variable TM_ACC_CMPON is also set equal to zero any time the variable IN_DEFROST is true as noted in step 58. As will be discussed in detail hereinafter, the variable IN_DEFROST is only true during a defrost of the outdoor coil. The variable TM_ACC_CMPON is hence allowed to accrue time following a defrost operation. Referring to steps 50, 76 and 78, the variable TM_ACC_CMPON is allowed to accrue time following a defrost action when the timer associated therewith is on in step 78 as a result of the compressor relay having been just turned on. The time recorded by TM_ACC_CMPON will continue to accrue time until the compressor is turned off as noted by the steps 50 and 52. When this occurs, the control processor will proceed to step 110 and turn off the time being recorded by both TM_CMPON as well as TM_ACC_CMPON. The time accrued by TM_ACC_CMPON will merely remain at its present value. Thus when the compressor relay R2 is again turned on, the variable TM_ACC_CMPON will accrue farther time unless a defrost action has occurred or a heat mode has been de-selected. It is to be appreciated that at some point the total amount of compressor on time following a defrost action will have reached thirty minutes.

Referring again to step 116, in the event that the total amount of accumulated compressor on time exceeds thirty minutes, the control processor will proceed to a step 118 to read the outdoor coil temperature from the thermistor 34 and store this value in the variable T_OCOIL. The control processor will next inquire in a step 120 as to whether the outdoor coil temperature value that is stored in the variable T_OCOIL is less than minus two degrees centigrade. If the outdoor coil temperature is not less than minus two degrees Centigrade, the control processor will simply proceed to step 68 and thereafter proceed to exit step 74 as has been previously discussed. Referring again to step 120, in the event that the temperature of the outdoor coil is less than minus two degrees Centigrade, the control processor will proceed to set the variable IN_DEFROST equal to true in a step 122. The control processor will proceed out of step 122 to step 68 and note that the compressor relay is on. This will prompt the processor to proceed to step 82 and inquire whether the outdoor fan relay R1 is on. If the outdoor fan relay R1 is on, the control processor will proceed along the yes path to step 84 and read the indoor fan speed and store this value in CUR_FNSPD. The processor will next compare the value of CUR_FNSPD with the value of OLD_FNSPD in step 86. CUR_FNSPD will be set equal to the value of OLD_FNSPD if necessary in step 88 before the processor sets TM_DFSET equal to zero in step 70 and proceeds to step 72. Since IN_DEFROST is now true, the control processor will proceed along the yes path out of step 72 to a defrost routine in a step 124. It is to be appreciated that the defrost routine will include setting the relay R3 so that the reversing valve 16 will reverse the direction of the refrigerant flow between the fan coils 10 and 12. The defrost routine will also set relay R1 so as to cause the outdoor fan 24 to be turned off. The subsequent reversal of refrigerant flow with the fan 24 being off will cause the outdoor coil to absorb heat from the refrigerant thereby beginning the removal of any frost build up on the coil. The control processor will proceed from step 124 to a step 126 and inquire whether the temperature of the outdoor coil as measured by the thermistor 34 has risen to a temperature greater than eighteen degrees centigrade. It is to be appreciated that the outdoor coil will take some time to rise to a temperature of eighteen degrees Centigrade. This will prompt the processor to continually proceed along the yes path out of step 58 each time the defrost logic of FIGS. 5A–5D is executed. The control processor will proceed from step 58 to steps 62 and 64 and continually set the total accumulated on time variables TM_ACC_CMPON and MAX_TEMP equal to zero. It will also set TM_DFDEL equal to zero in step 66. This effectively initializes all these variables as long as the control processor is implementing a defrost of the outdoor coil 12. The control processor proceeds, after having set the above variables equal to zero, through step 68, 82, 84, 86 and 72 so as to again implement the defrost routine. Referring to step 126 when the outdoor coil temperature rises to a temperature greater than eighteen degrees Centigrade, the control processor will proceed to step 128 and set the variable, IN_DEFROST, equal to false before exiting the defrost logic in step 74. It is to be noted that the next execution of the defrost control logic will prompt the control processor to again encounter step 58 and note that IN_DEFROST is no longer true. The control processor will proceed through step 58 to step 60 as long as the mode of heat continues to remain selected. As has been previously discussed, the processor will exit out of step 81 along the no path until the conditions of the compressor, outdoor fan and indoor fan speed have been satisfied. It is to be appreciated that the value of TM_ACC_CMPON as well as MAX_TEMP will now be able to accrue values other than zero when the compressor relay R2 is on. The maximum delta value will begin to accrue a temperature value when the time denoted by TM_DFSET is greater than sixty seconds, which occurs as soon as the compressor relay and outdoor fan have been turned on plus the indoor fan speed has not changed between successive executions of the logic. As has been previously discussed when TM_DFSET exceeds sixty seconds, the calculation of a DEFROST_DELTA will also begin to occur again. The comparison in step 108 of the current value of T_ICOIL with the value of MAX_TEMP reduced by the value of DEFROST_DELTA will thereafter determine when it is appropriate to examine the various timing values of steps 112, 114 and 116.

It is to be appreciated that a defrost cycle will only be initiated if the further examination of TM_DFDEL and the compressor times denoted by TM_CMPON and TM_ACC_CMPON indicate that appropriate amounts of time have elapsed. Once all of these conditions are satisfied, the variable IN_DEFROST will again be set equal to true allowing the processor to initiate the defrost routine.

While the invention has been described with reference to a preferred embodiment, it will be understood by those skilled in the art that various changes may be made thereto without departing from the scope of the invention. For example, the linear calculations of DEFROST_DELTA in steps 102 and 104 could be replaced by appropriate calculations of defrost delta based on a non-linear relationship between DEFROST_DELTA and the variable MAX_TEMP. Such a calculation would in fact more closely follow the mathematical curve defining the relationship of $\Delta T_d$ to $T_{MAX}$ in FIG. 3. It is also to be appreciated that the mathematical curve of FIG. 3 could change in the event that a different heat pump system having a different compressor, fans and other heat pump components were analyzed. Such a heat pump system could be similarly tested and the appropriate relationship defined as discussed with respect to FIGS. 2 and 3. For the above reasons, it is therefore intended that the invention not be limited to the particular embodiment disclosed, but that the invention include all the embodiments falling within the scope of the claims hereinafter set forth.

What is claimed is:

1. A method executable by a computer means that is operative to initiate defrost actions of an outdoor coil of a heat pump, said method comprising the steps of:

repetitively reading the temperature of an indoor coil of the heat pump from an indoor coil temperature sensor following the last defrosting of the outdoor coil;

determining the maximum indoor coil temperature to have been read from the readings of the temperature of the indoor coil that have occurred following the last defrosting of the outdoor coil;

computing a limit as to the drop in a read indoor coil temperature that may be permitted from the determined maximum indoor coil temperature wherein the limit is computed as a function of the then determined maximum indoor coil temperature and;

determining whether a defrost action of the outdoor coil should be activated when a read indoor coil temperature as sensed by the indoor coil temperature sensor indicates a drop below the then determined maximum indoor coil temperature of more than the limit computed as a function of the then determined maximum indoor coil temperature.

2. The method of claim 1 wherein said step of determining whether a defrost action of the outdoor coil of the heat pump system should be activated comprises the step of:

delaying any defrost action until the indoor coil temperature has been successively read at least one further time following a determination that the indoor coil temperature indicates a drop below the then determined maximum indoor coil temperature of more than the computed limit and wherein such successively read indoor coil temperature indicates that the indoor coil temperature as sensed by the indoor coil temperature sensor remains below the determined maximum indoor coil temperature by more than the computed limit.

3. The method of claim 2 wherein said step of determining whether a defrost action of the outdoor coil should be activated further comprises the steps of:

determining whether a compressor in the heat pump has been continuously on for a predetermined period of time; and proceeding to further determine whether a defrost action should be initiated only after the compressor has been continuously on for the predetermined period of time.

4. The method of claim 3 wherein said step of proceeding to further determine whether a defrost action of the outdoor coil should be initiated comprises the step of:

determining whether the compressor has been on for a predetermined period of accumulated time since the outdoor coil of the heat pump system was previously defrosted.

5. The method of claim 4 wherein said step of determining whether the compressor has been on for a predetermined period of accumulated time comprises the steps of:

monitoring the on time of the compressor following termination of a previous defrost action;

incrementally adding any presently monitored on time to a sum of previously monitored on time of the compressor after the previous defrost action so as to produce a present sum of on time of the compressor;

comparing the present sum of compressor on time with the second predetermined period of time; and proceeding to further determine whether a defrost action should be initiated when the present sum of on time exceeds the predetermined period of accumulated time since the outdoor coil of the heat pump system was defrosted.

6. The method of claim 1 wherein said step of determining the maximum indoor coil temperature to have read from the reading of the temperature of the indoor coil that have occurred following the last defrosting of the outdoor coil comprises the steps of:

determining whether the current read value of indoor coil temperature exceeds any previously read value of maximum indoor coil temperature occurring since the last defrosting of the outdoor coil; and storing the current read value of indoor coil temperature as the maximum indoor coil temperature when the currently read value of indoor coil temperature exceeds the previously noted maximum indoor coil temperature occurring since the last defrost of the outdoor coil.

7. The method of claim 1 further comprising the steps of:

detecting whether a predetermined period of time has elapsed during which the speed of an indoor fan associated with the indoor coil has remained constant while both a compressor in the heat pump system and a fan associated with the outdoor coil have remained on; and proceeding to said step of repetitively reading the temperature of the indoor coil of the heat pump system when the predetermined period of time has elapsed.

8. The method of claim 7 wherein said step of detecting whether a predetermined period of time has elapsed during which the speed of an indoor fan associated with the indoor coil has remained constant while both a compressor in the heat pump system and a fan associated with the outdoor coil have remained on further comprising the steps of:

establishing a count of the predetermined period of time that must elapse during which the speed of the indoor fan must remain constant while both the compressor and fan associated with the outdoor coil must remain on; and resetting the count of the predetermined time when either the indoor fan speed changes, the compressor is turned off or the fan associated with the outdoor coil is turned off.

9. The method of claim 1 wherein the limit being computed as a function of the value of the determined maximum indoor coil temperature is derived from observing a heat pump of the same design operate under a variety of different system and ambient conditions and noting the maximum indoor coil temperature of the system and the drop in temperature from the noted maximum indoor coil temperature when substantial frosting of the outdoor coil occurs during each such observed operation whereby a relationship is developed between noted maximum indoor coil temperature and the drop from the noted maximum indoor coil temperature.

10. A system for controlling the defrosting of an outdoor coil of a heat pump, said system comprising:

a sensor for sensing the temperature of an indoor coil of the heat pump;

a device for defrosting the outdoor coil of the heat pump; and computer means operative to repetitively read the sensed temperature of the indoor coil from said sensor so as to determine the maximum indoor coil temperature to have been read from said sensor since the last defrosting of the coil, said computer means further being operative to determine whether a read temperature from said sensor has dropped below the then determined maximum indoor coil temperature by an amount computed by said computer means as a function of the then determined maximum indoor coil temperature, said computer means being operative to send a defrost signal to said device for defrosting the outdoor coil when a read temperature of the indoor coil has dropped below the then determined maximum indoor coil temperature by the computed amount and the computer means has noted that a particular component of the heat pump has been operational over a predetermined period of time.

11. The system of claim 10 wherein said computer means is operative to at least read and confirm for a second time that the temperature read from said sensor remains below the then determined maximum indoor coil temperature by an amount computed as a function of the then determined maximum indoor coil temperature before proceeding to send a defrost signal to said device for defrosting the outdoor coil.

12. The system of claim 10 wherein said computer means is operative to repetitively read the temperature from said sensor over a predetermined period of time following the initial determination that a read temperature from said sensor has dropped below the then determined maximum indoor coil temperature by the computed amount, said computer means being operative to confirm that the repetitively read temperatures from said sensor remain below the maximum indoor coil temperature by the computed amount over the predetermined period of time before sending the defrost signal to the device for defrosting the outdoor coil.

13. The system of claim 10 wherein the particular component of the heat pump being noted as having been operational is a compressor within the heat pump.

14. The system of claim 10 wherein said defrost device comprises:

a reversing valve within the heat pump for reversing the flow of refrigerant within the heat pump.

15. The system of claim 10 wherein said heat pump includes an indoor fan associated with the indoor coil and an outdoor fan associated with an outdoor coil and wherein said computer means is operative to verify that the running status of the fans has not changed before proceeding to said step of repetitively reading the sensed temperature of the indoor coil.

16. The system of claim 10 further comprising:

a sensor for sensing the temperature in the vicinity of the outdoor coil, and wherein said computer means being operative to condition the sending of the defrost signal to said device for defrosting the outdoor coil depending on the value of the temperature read from said sensor for sensing the temperature in the vicinity of the outdoor coil.

* * * * *